United States Patent [19]

Atkins et al.

[11] 4,248,798

[45] Feb. 3, 1981

[54] NEW METHOD FOR PREPARING PENTANITROANILINE AND TRIAMINOTRINITROBENZENES FROM TRINITROTOLUENE

[75] Inventors: Ronald L. Atkins, Ridgecrest; Arnold T. Nielsen, China Lake; William P. Norris, Ridgecrest, all of Calif.

[73] Assignee: The United States of America as represented by the Secretary of the Navy, Washington, D.C.

[21] Appl. No.: 116,351

[22] Filed: Jan. 28, 1980

[51] Int. Cl.[3] ..... C07C 85/00; C07C 85/02; C07C 85/11; C07C 85/26

[52] U.S. Cl. ..... 564/441

[58] Field of Search ..... 260/581, 645, 580, 582, 260/578

[56] References Cited

U.S. PATENT DOCUMENTS

| | | | |
|---|---|---|---|
| 1,045,011 | 11/1912 | Flurschein | 260/578 |
| 3,002,998 | 10/1961 | Kaplan et al. | 260/581 |
| 3,092,671 | 6/1963 | Humphrey et al. | 260/645 |
| 3,654,363 | 4/1972 | Pum et al. | 260/577 |
| 3,928,475 | 12/1975 | Dassel | 260/645 |
| 3,976,704 | 8/1976 | Vaughan | 260/645 |
| 4,032,377 | 6/1977 | Benzigar | 260/581 |

*Primary Examiner*—John Doll

*Attorney, Agent, or Firm*—Sciascia; W. Thom Skeer; Lloyd E. K. Pohl

[57] ABSTRACT

Trinitrotoluene is selectively reduced by reaction with $H_2S$ in p-dioxane to produce 4-amino-2,6-dinitrotoluene. This latter compound is then nitrated with $HNO_3$ in $H_2SO_4$ to produce pentanitroaniline which is, in turn, reacted with $NH_3$ in benzene, methylene chloride or another suitable solvent to produce triaminotrinitrobenzene (TATB). TATB is useful as an explosive.

8 Claims, No Drawings

NEW METHOD FOR PREPARING PENTANITROANILINE AND TRIAMINOTRINITROBENZENES FROM TRINITROTOLUENE

BACKGROUND OF THE INVENTION

1. Field of the Invention

This invention relates to a new and improved method for preparing pentanitroaniline from trinitrotoluene and to the subsequent preparation of triaminotrinitrobenzene from the pentanitroaniline.

2. Description of the Prior Art

Triaminotrinitrobenzene (TATB) is a highly desirable, insensitive explosive that is used primarily in special applications. The reason that it is used only in special applications is its expense. It is too expensive to use in ordinary applications if other, less expensive explosives can be used in its stead.

The major reason that TATB is so expensive is that it is prepared from trichlorobenzene which is expensive and not available from domestic suppliers. Accordingly, it would be advantageous to have an easily carried out method for its preparation from a readily available, inexpensive precurser.

SUMMARY OF THE INVENTION

According to this invention, the 4-nitro group or trinitrotoluene (TNT) is selectively reduced by $H_2S$ in p-dioxane to produce 4-amino-2,6-dinitrotoluene. This latter compound is then nitrated with $HNO_3$ in $H_2SO_4$ to produce pentanitroaniline. Finally the pentanitroaniline is reacted with $NH_3$ in benzene, methylene chloride or another suitable solvent to produce a quantitative yield of TATB. The method of this invention is easily carried out and all reactants are inexpensive.

DESCRIPTION OF THE PREFERRED EMBODIMENTS

The method of this invention may be practiced by carrying out the procedures set forth in the following specific examples.

EXAMPLE 1

25 g of trinitrotoluene are dissolved in 50 ml of p-dioxane containing 1 ml concentrated $NH_4OH$. (The $NH_4OH$ acts as a catalyst.) $H_2S$ is bubbled in for 25 to 30 minutes keeping the temperature below 40° C. Sulfur precipitates as the $H_2S$ is bubbled in and, after the 25 to 30 minutes, is filtered off. The filtrate is poured into 200 ml of ice water. A bright yellow solid precipitates and is washed with 100 ml of $H_2O$. This precipitate is a mixture of 4-amino-2,6-dinitrotoluene and the intermediate reduction product 2,6-dinitro-4-hydroxylaminotoluene. The desired product, 4-amino-2,6-dinitrotoluene is purified by recrystallization from methanol with an overall yield of from 60 to 70%. Alternatively, the crude mixture is suspended in 3 N HCl, an equivalent of KI is added and the mixture is refluxed until iodine vapors cease to be evolved. Cooling and filtration gives 20.7 g of the desired product (96% yield) when this latter technique is used. This latter technique represents the best mode of practicing the invention because an almost quantitative yield of the desired intermediate, 4-amino-2,6-dinitrotoluene is obtained.

EXAMPLE 2

1 g of 4-amino-2,6-dinitrotoluene is dissolved in 40 ml of 96% $H_2SO_4$. 3 ml of 90% $HNO_3$ are added dropwise. The addition is accompanied by an exotherm to 40° C. The suspension is then heated for 1 hour at 70° C. and then allowed to cool to room temperature. Then the acid solution is extracted with methylene chloride and the extract is dried over $MgSO_4$. The solids, upon evaporation of methylene chloride, represent a yield of 62.4% of pentanitroaniline.

EXAMPLE 3

1 g of pentanitroaniline is dissolved in 100 ml benzene, methylene chloride or another suitable solvent and anhydrous $NH_3$ is bubbled in. Triaminotrinitrobenzene precipitates from solution. The TATB is filtered and washed with $H_2O$ giving a quantitative yield. Other suitable solvents include toluene and the xylenes.

The foregoing examples set forth specific times and temperatures. These times and temperatures may be varied somewhat. For example, the 25 to 30 minutes of Example 1 may be varied to from a few minutes to infinity. As another example, the 1 hour time specified in Example 2 may be varied to from a few minutes up to an infinitely long time and the temperature (70° C.) may be varied in the range of from about 65° C. to about 75° C. The 1 hour time and 70° C. temperature set forth merely represent the best mode of practicing the invention known to the inventors. Also, the specific amounts of reactants set forth may be varied considerably. Excesses of either reactant in any of the examples may be used.

What is claimed is:

1. A method for preparing triaminotrinitrobenzene comprising the steps of:

A. reacting trinitrotoluene with $H_2S$ to produce a reaction product which contains 4-amino-2,6-dinitrotoluene and 2,6-dinitro-4-hydroxylaminotoluene;

B. recrystallizing the reaction product to obtain purified 4-amino-2,6-dinitrotoluene;

C. nitrating the 4-amino-2,6-dinitrotoluene with $HNO_3$ in $H_2SO_4$ to produce pentanitroaniline; and D. reacting the pentanitroaniline with $NH_3$ to produce triaminotrinitrobenzene.

2. A method according to claim 1 wherein the reaction of trinitrotoluene with $H_2S$ is carried on for 25 to 30 minutes in the presence of $NH_4OH$.

3. A method according to claim 2 wherein the nitration of 4-amino-2,6-dinitrotoluene is carried on for about 1 hour at a temperature of about 70° C.

4. A method according to claim 3 wherein the reaction of pentanitroaniline with $NH_3$ is carried out in a solvent selected from the group consisting of benzene, methylene chloride, toluene and the xylenes.

5. A method for preparing triaminotrinitrobenzene comprising the steps of:

A. reacting trinitrotoluene with $H_2S$ to produce a reaction product which contains 4-amino-2,6-dinitrotoluene and 2,6-dinitro-4-hydroxylaminotoluene;

B. reacting the reaction product with KI to convert the 2,6-dinitro-4-hydroxylaminotoluene to 4-amino-2,6-dinitrotoluene;

C. nitrating the 4-amino-2,6-dinitrotoluene with $HNO_3$ in $H_2SO_4$ to produce pentanitroaniline; and D. reacting the pentanitroaniline with $NH_3$ to produce triaminotrinitrobenzene.

6. A method according to claim 5 wherein step A is carried out for from 25 to 30 minutes in the presence of $NH_4OH$.

7. A method according to claim 6 wherein step C is carried out for about 1 hour at a temperature of about 70° C.

8. A method according to claim 7 wherein step D is carried out in the presence of a solvent selected from the group consisting of benzene and methylene chloride, toluene and the xylenes.

* * * * *